US008322269B2

(12) United States Patent
Sullivan et al.

(10) Patent No.: US 8,322,269 B2
(45) Date of Patent: Dec. 4, 2012

(54) WEAPONS STABILIZATION AND COMPENSATION SYSTEM

(75) Inventors: Jacob Ryan Sullivan, Emeryville, CA (US); John Holbrook Vance, II, Oakland, CA (US)

(73) Assignee: Flex Force Enterprises LLC, Portland, OR (US)

( * ) Notice: Subject to any disclaimer, the term of this patent is extended or adjusted under 35 U.S.C. 154(b) by 409 days.

(21) Appl. No.: 12/651,966

(22) Filed: Jan. 4, 2010

(65) Prior Publication Data

US 2011/0042459 A1 Feb. 24, 2011

Related U.S. Application Data

(60) Provisional application No. 61/150,518, filed on Feb. 6, 2009.

(51) Int. Cl.
*F41G 5/00* (2006.01)

(52) U.S. Cl. ..... 89/41.11

(58) Field of Classification Search ..... 89/37.01, 89/37.03, 37.07, 37.12, 37.13, 37.09, 41.02, 89/41.04–41.06, 41.09, 41.11, 41.14–41.16, 89/41.22, 201–206

See application file for complete search history.

(56) References Cited

U.S. PATENT DOCUMENTS

| | | | | |
|---|---|---|---|---|
| 969,614 | A * | 9/1910 | Florenz | 114/195 |
| 1,507,209 | A * | 9/1924 | Schneider | 89/41.14 |
| 2,448,612 | A * | 9/1948 | McLaren | 318/257 |
| 2,487,062 | A * | 11/1949 | Manes | 89/37.03 |
| 2,554,019 | A * | 5/1951 | Du Bois | 89/37.02 |
| 3,438,305 | A * | 4/1969 | Nollet | 89/41.22 |
| 7,210,391 | B2 * | 5/2007 | Beckmann | 89/37.03 |
| 2004/0050240 | A1 * | 3/2004 | Greene et al. | 89/41.06 |
| 2007/0261544 | A1 * | 11/2007 | Philippe | 89/41.05 |
| 2008/0034954 | A1 * | 2/2008 | Grober | 89/41.05 |
| 2008/0048033 | A1 * | 2/2008 | Quinn | 235/411 |

* cited by examiner

*Primary Examiner* — Bret Hayes
*Assistant Examiner* — Reginald Tillman, Jr.
(74) *Attorney, Agent, or Firm* — Mintz, Levin, Cohn, Ferris, Glovsky and Popeo, P.C.

(57) ABSTRACT

Disclosed herein are stabilized weapon mount systems that allow a gunner (i.e. operator of a weapon) to mount and operate a standard weapon in a manner similar to a stand-alone weapon while compensating for the motion of the platform. The system includes an aiming gimbal that is movable by an operator during stabilization into an aiming orientation directed toward a target and a stabilization gimbal nested within the aiming gimbal and adapted to securely couple to a weapon. The stabilization gimbal and aiming gimbal are mechanically coupled by a control unit such that the stabilization gimbal is moved by the control unit and the aiming gimbal is not moved by the control unit. A stabilization device automatically commands the control unit to move the stabilization gimbal relative to the aiming gimbal using the motors to correct for the base movement and maintain the aiming orientation directed toward the target.

20 Claims, 9 Drawing Sheets

WEAPONS STABILIZATION AND COMPENSATION SYSTEM

REFERENCE TO PRIORITY DOCUMENT

This application claims priority of U.S. Provisional Patent Application Ser. No. 61/150,518, entitled "Stabilized Weapon Mount," filed Feb. 6, 2009. Priority of the filing date of Feb. 6, 2009, is hereby claimed, and the disclosure of the Provisional patent application is hereby fully incorporated by reference.

BACKGROUND

Mobile military weapons platforms (e.g. boats, trucks, etc.) are typically not stable platforms for mounting ballistic weapon systems (e.g. machine guns, etc.). As a result, such accuracy of such weapon systems can be greatly reduced when the corresponding platform is moving. Engaging an erratically moving target from an erratically moving firing platform can be difficult for even the best-trained war fighter. Once a target has been detected, identified, assessed and acquired, there are key obstacles to overcome, including, for example, correction for the motion of the platform (e.g. the pitch and roll of a boat, etc.), and correction for the range and motion of the target (e.g. target tracking or lead/ballistic correction, etc.).

Conventional stabilized weapon platforms have motors connected to each axis (e.g. azimuth and elevation) and motion sensors connected to the base platform (e.g. the boat or truck). The motors control the aim of the weapon relative to the base platform. The operator aims the platform using an input device (usually very similar to a video game control pad). The system control software reads the data from the operator input device and from the stabilization sensors and determines how fast each motor should move. The problem with this approach is that it requires the operator be physically separated from the weapon. Although it allows the operator to be located somewhere safer (e.g. under armor), that advantage is negated when the vehicle does not have armor.

SUMMARY

Described herein is a stabilized weapon mount system including a base including at least one motion sensor adapted to sense base movement; an aiming gimbal moveably mounted to the base having an operator interface, a first position sensor, and a second position sensor. The aiming gimbal is movable by an operator during stabilization into an aiming orientation directed toward a target. The system also includes a control unit including a first motor and a second motor; a stabilization gimbal nested within the aiming gimbal and adapted to securely couple to a weapon. The stabilization gimbal and aiming gimbal are mechanically coupled by the control unit such that the stabilization gimbal is moved by the control unit and the aiming gimbal is not moved by the control unit. The system also includes a stabilization computational device electrically interfaced with the at least one motion sensor of the base, the first and second position sensors of the aiming gimbal, and the control unit. The stabilization computational device automatically commands the control unit to move the stabilization gimbal relative to the aiming gimbal using one or more of the first motor and the second motor to correct for the base movement sensed by the at least one motion sensor and maintain the aiming orientation directed toward the target.

The systems described herein can also include a base that is affixed to a platform of a movable vehicle. The systems described herein can correct for base movement that includes rotational motion, linear motion or a combination of rotational and linear motion. The aiming gimbal can remain substantially stationary when the control unit moves the stabilization gimbal. The first motor can include an elevation motor and the second motor can include an azimuth motor. The first position sensor can include an elevation sensor and the second position sensor can include an azimuth sensor. The aiming gimbal can have two degrees of freedom with respect to the base: azimuth and elevation. The stabilization gimbal can have two degrees of freedom with respect to the aiming gimbal: azimuth and elevation. The aiming gimbal can be coupled to at least a third motor for remote operation or can be manually moved by the operator. The at least one motion sensor can include a plurality of axis motion sensors such as a gyroscope, an accelerometer or a combination thereof. The plurality of axis motion sensors can detect motion in at least one of six degrees of freedom such as pitch, roll, yaw, x, y, or z.

The operator interface can be adapted to operate the weapon like a stand-alone weapon. The system can also include a target sensor adapted to adjust for motion, range and speed of the target. The target sensor can include a manual user input device. The system can also include a safety switch coupled to the operator interface that disables the control unit of the stabilization gimbal when released by the operator. The at least one motion sensor can be adapted to detect sudden or large base movement and activate at least one of a pan assist and a tilt assist coupled to the aiming gimbal to limit motion of the aiming gimbal relative to the base and prevent operator-induced error. The system can be adapted to be controlled remotely.

Also disclosed herein is a stabilizing weapon mount system including a base including at least one motion sensor adapted to sense base movement in at least one of six degrees of freedom; an aiming gimbal moveably mounted to the base in two degrees of freedom, the aiming gimbal having an aiming orientation directed toward a target; a first sensor positioned on the aiming gimbal, the first sensor adapted to detect elevation data of the aiming gimbal; a second sensor positioned on the aiming gimbal, the second sensor adapted to detect azimuth data of the aiming gimbal; a control unit including an elevation motor and an azimuth motor; a stabilization gimbal nested within the aiming gimbal in two degrees of freedom and adapted to securely couple to a weapon; and a stabilization computational device electrically interfaced with the at least one motion sensor of the base, the first and second sensors of the aiming gimbal, and the control unit. The stabilization gimbal and the aiming gimbal are mechanically coupled by the control unit such that the stabilization gimbal is moved by the control unit and the aiming gimbal is not moved by the control unit. The stabilization computational device automatically corrects for the base movement sensed by the at least one motion sensor by commanding the control unit to move the stabilization gimbal using one or more of the first motor and the second motor to maintain the aiming orientation directed toward the target while the aiming gimbal remains substantially stationary.

Also disclosed herein is a method of stabilizing a weapon coupled to a moving vehicle including detecting aiming orientation of an aiming gimbal directed toward a target, the aiming gimbal moveably mounted in two degrees of freedom to a base having at least one motion sensor, the base coupled to the moving vehicle; detecting elevation of the aiming gimbal with a first sensor on the aiming gimbal; detecting azimuth of the aiming gimbal with a second sensor on the aiming gimbal; reporting elevation and azimuth data of the aiming gimbal to a stabilization computational device to calculate a first vector of the aiming gimbal; detecting base motion with the at least one motion sensor in one of six degrees of freedom; reporting base motion data to the stabilization computational device to calculate a second vector; calculating the difference in azimuth and elevation between the first vector and the second vector to generate a correction command; transmitting the correction command to a control unit including a first motor and a second motor. The stabilization gimbal and the aiming gimbal are mechanically coupled by the control unit such that stabilization gimbal is nested within the aiming gimbal and moved by the control unit. The method also includes automatically correcting for the difference in one or more of azimuth and elevation with the control unit by moving the stabilization gimbal relative to the aiming gimbal using one or more of the first motor and the second motor to maintain the aiming orientation while the aiming gimbal remains substantially stationary.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

These and other aspects will now be described in detail with reference to the following drawings. Generally speaking the figures are not to scale in absolute terms or comparatively but are intended to be illustrative of claimed features. Also, relative placement of features and elements may be modified for the purpose of illustrative clarity. Many of the figures show the components in schematic for the purpose of simplicity and are not intended to specifically show the design of the components or how they are coupled together.

DETAILED DESCRIPTION

Described herein is a system that allows a gunner (i.e., operator of a weapon) to mount and freely operate a standard weapon while compensating for both the motion of the mobile weapons platform and the target. The system also allows the gunner to operate the stabilized system in a manner similar to how a stand-alone weapon is operated.

The subject matter described herein provides many advantages. For example, the stabilized weapon platform allows a user (such as a gunner or operator of a weapon) to mount and operate a standard weapon using the stabilizing system in a manner similar to how he/she would operate the weapon independent of the stabilizing system while compensating for both the motion of the mobile weapons platform and the target. Unlike other weapon stabilized weapon systems, the stabilization motors of the systems described herein do not determine where the weapon is aimed with respect to the base platform. The stabilization motors of the systems described herein determine where the weapon is aiming relative to the aiming gimbal. In particular, advantages include improved safety, reliability, simplicity and accuracy.

The disclosed systems do not require motors to drive the aiming gimbal to stabilize the weapon. This improves the safety of the system compared to systems where the motors are between the platform and the aiming gimbal resulting in an operator being hurt if the motors suddenly move due to malfunction or platform motion. The operator of the disclosed device is not at risk in the event of a motor or control system malfunction. Further, because the motors of the disclosed system are between the aiming gimbal and the stabilization gimbal, their failure does not cripple the system. If the motors fail, the system can be operated like a standard non-stabilized weapon mount.

The disclosed systems also have the advantage of simplicity in design and an operator interface that mimics the grip of the stabilized weapon. This minimizes the training requirement for operation. Eliminating motion platform error improves accuracy and a war fighter's odds of hitting the target. Additionally, because the aiming gimbal is not motorized, the operator can still aim the platform while the stabilization is active and can "walk in the fire."

Figure 1A:
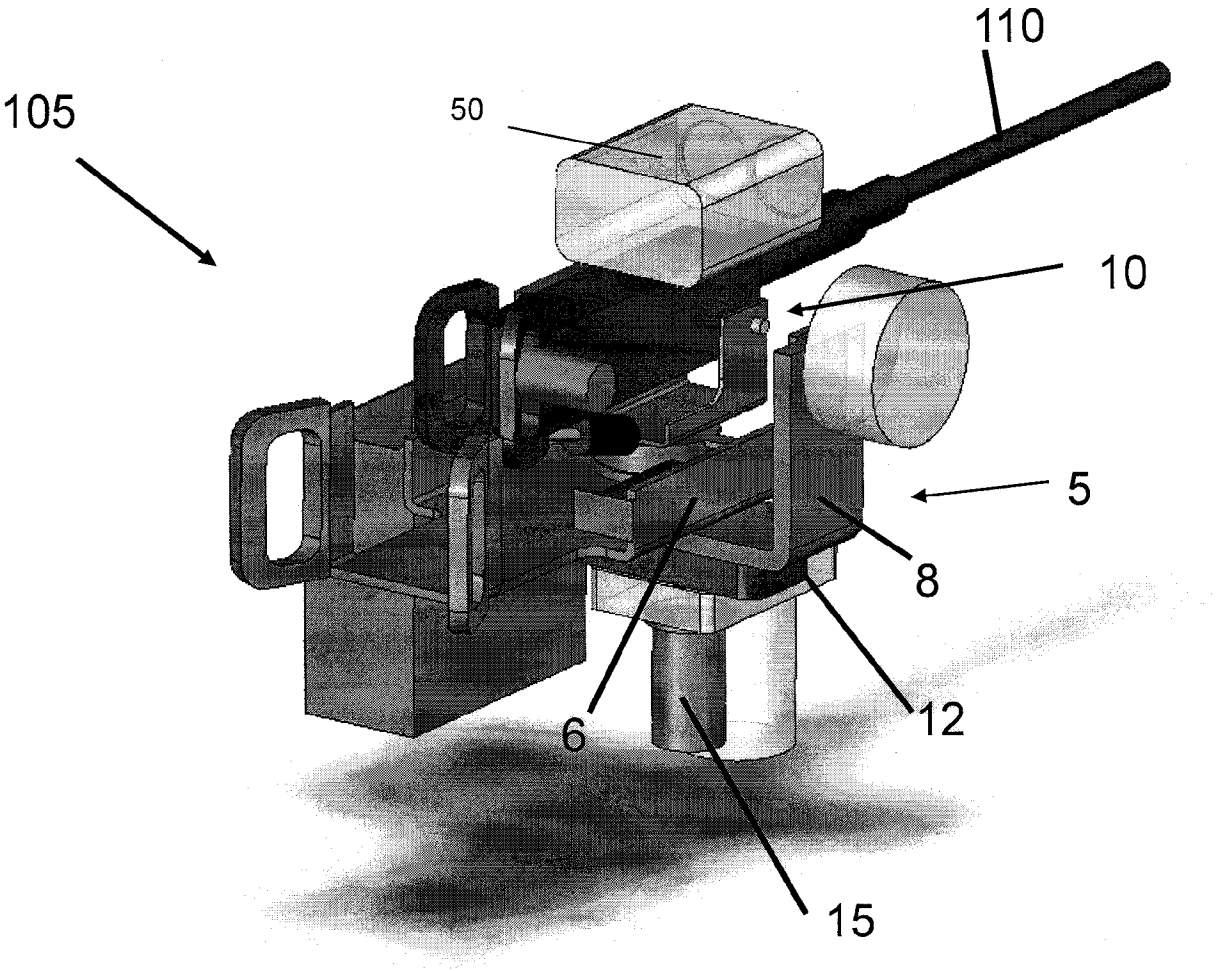
FIGS. 1A-1B are diagrams illustrating a weapon on a stabilized weapon mount.
Figure 1B:
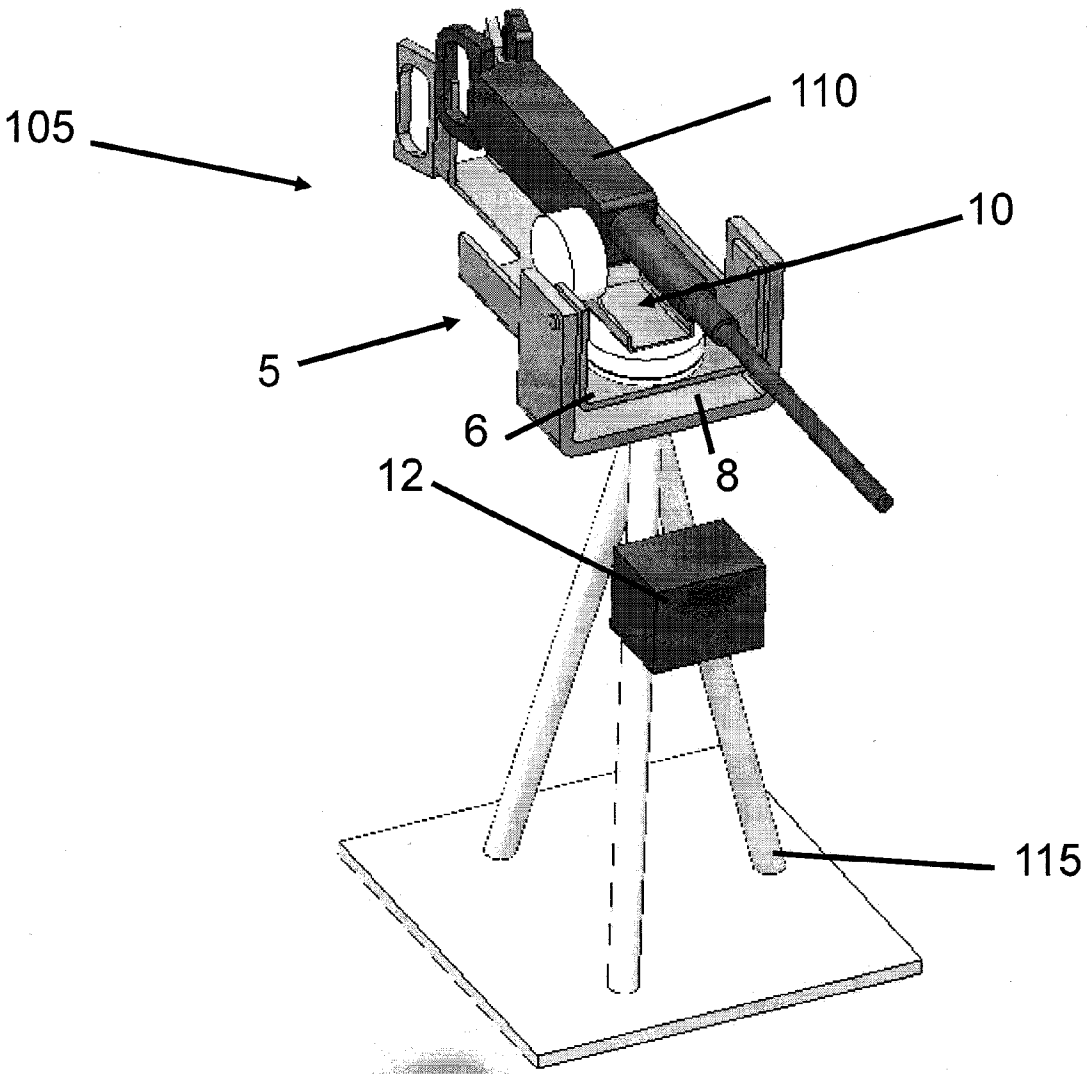

FIGS. 1A, 1B show schematics of various stabilized mount systems 105 with a device 110 coupled thereto. The mount system 105 can have a base 15 that fits into a receptacle such as a standard military weapon vehicle platform 115 (see FIG. 1B) found on vehicle turrets and other mounting locations of a moving vehicle such as military Humvees, off-road vehicles, boats, aircraft and unmanned vehicles. The stabilized mount system 105 allows hands-on control of the device 110, such as a weapon or other device while the stabilization is active.

The stabilized mount system 105 generally includes an aiming gimbal 5, a stabilization gimbal 10 and an electronics package 12. A gimbal can be characterized as a pivoted support that allows the rotation of an object about a single axis or set of axes. A gimbal with two degrees of freedom, two orthogonal axes, may be used to allow an object mounted on the innermost axis to retain the same aiming vector (e.g. stay horizontal or vertical), regardless of the motion of its support. The aiming gimbal 5 is not necessarily moved by any motors for the system to be stabilized. The aiming gimbal 5 can include an elevation frame 6 and an azimuth frame 8. The elevation frame 6 and azimuth frame 8 of the aiming gimbal 5 can be freely and directly aimed by the operator during normal operation of the stabilized mount system 105.

Figure 1C:
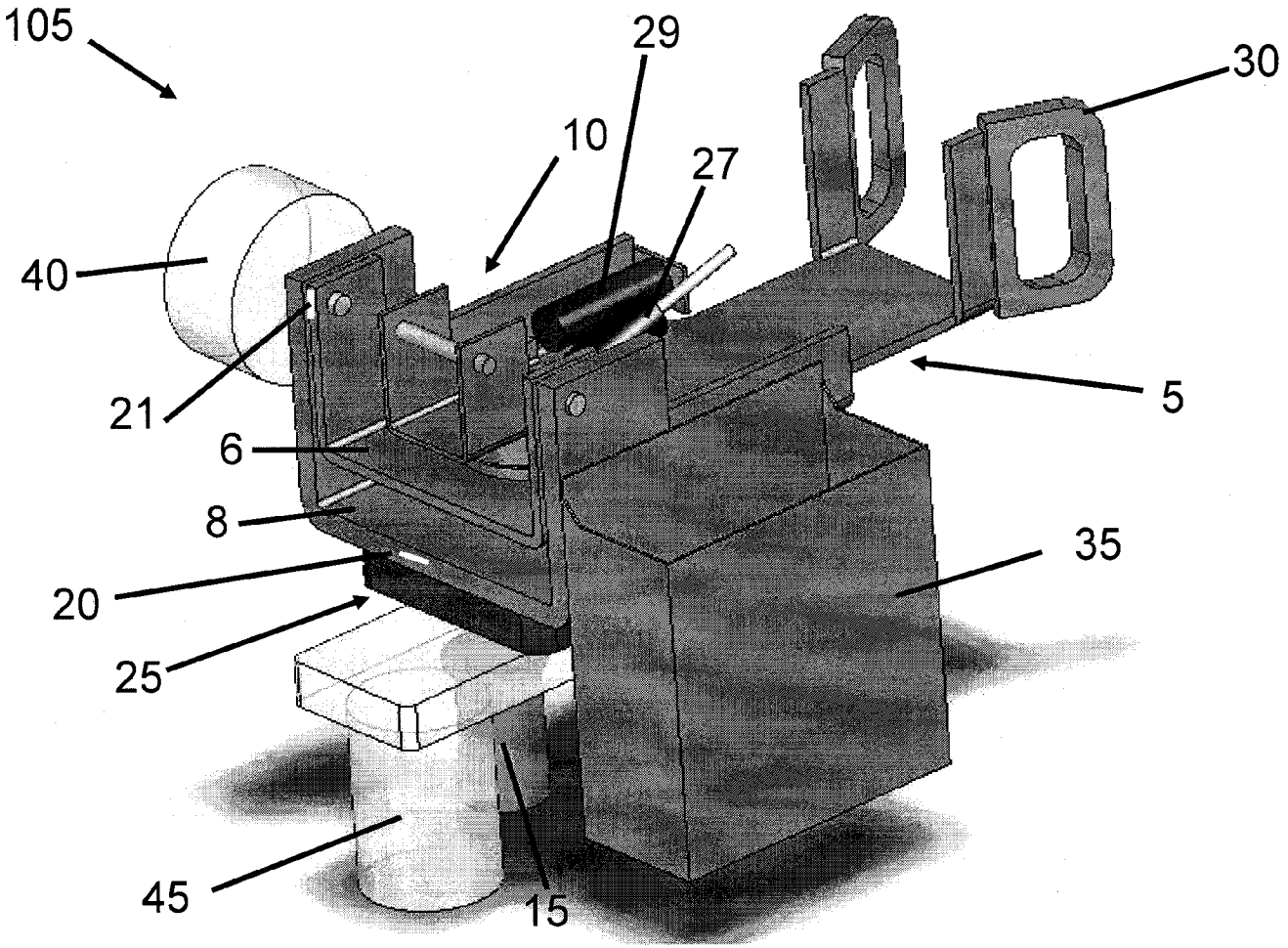
FIG. 1C illustrates a perspective view of a stabilized weapon mount.

With reference to FIG. 1C, the aiming gimbal 5 can include two position sensors, an azimuth sensor 20 positioned on the azimuth frame 8 and an elevation sensor 21 positioned on the elevation frame 6 for measuring the aiming gimbal 5 attitude with respect to an attachment interface such as a base 15 that fits into a receptacle such as a standard military weapon vehicle platform 115. The base 15 can be attached to a standard weapon platform 115 on a vehicle. The aiming gimbal 5 can have at least two degrees of freedom with respect to the base 15, azimuth and elevation. This unit vector represents where the operator of the weapon 110 wants the weapon 110 to be aimed. The base 15 of the stabilized weapon mount 105 can have one or more motion sensors forming a sensor suite 25 within the electronics package 12 that does not pan or tilt with the aiming gimbal 5, but stays stationary with respect to the base 15. The sensor suite 25 can include 3 axis motion detection sensors (e.g. gyroscopes and/or accelerometers, etc.) that measure the motion of the base 15 (e.g. pitch, roll, and yaw, and x, y, z linear motion). There are six degrees of freedom that can be measured and corrected for, but not all of them are needed for all applications.

Still with respect to FIG. 1C, the stabilization gimbal 10 can interface with the weapon 110 and mount to standard or customized law enforcement or military weapon(s). It should be appreciated that the stabilization gimbal 10 of the mount system 105 can be adapted such that it can be used for a variety of different weapons 110.

Figure 1D:
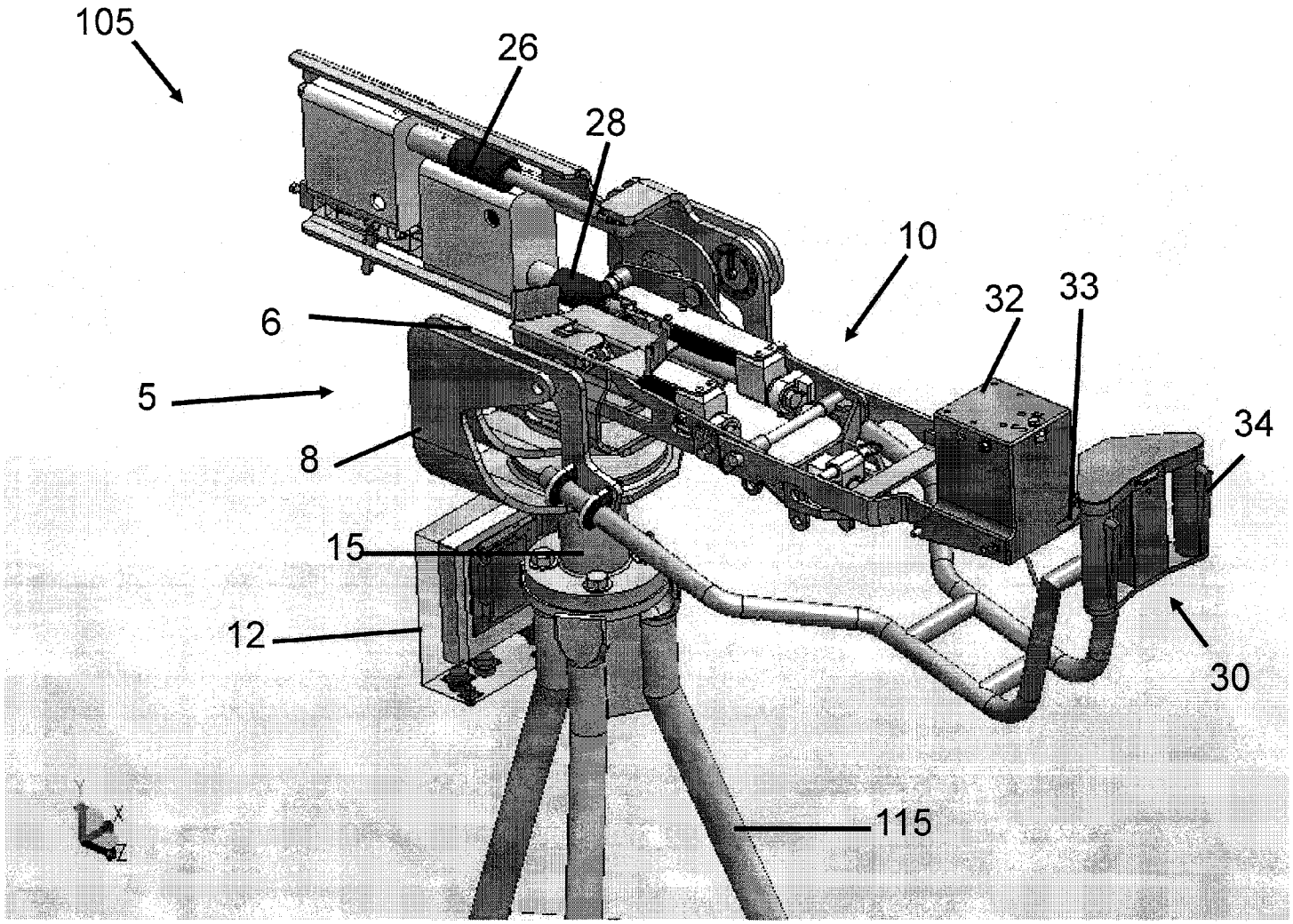
FIGS. 1D-1E illustrate perspective views of other stabilized weapon mounts.
Figure 1E:
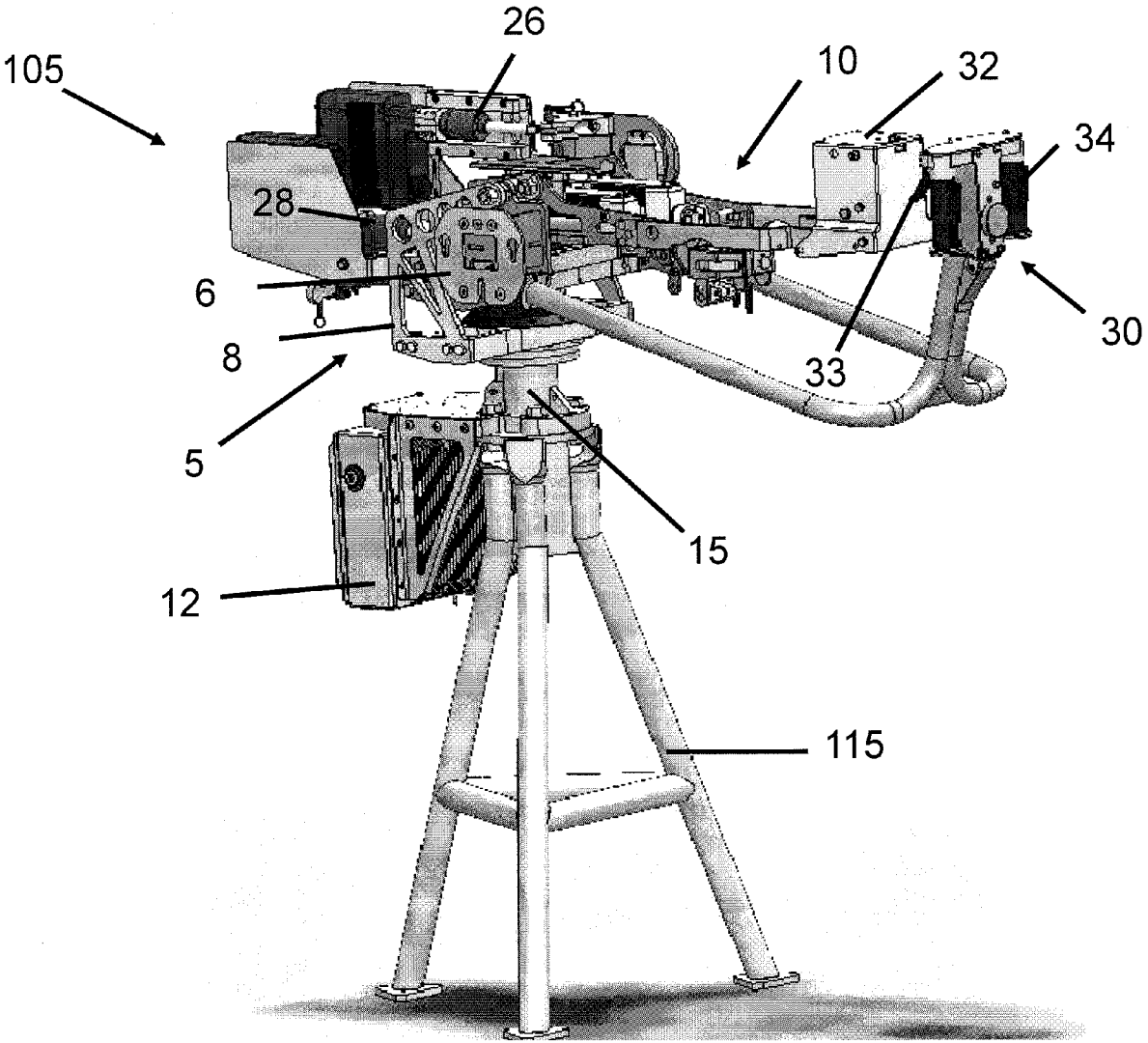

The aiming gimbal 5 and stabilization gimbal 10 are coupled together such that the stabilization gimbal 10 is nested between the aiming gimbal 5 and the weapon 110. The stabilization gimbal 10 can be motorized and include a tilt stabilizer 27 and a pan stabilizer 29 such that the stabilization gimbal 10 can adjust the aim point of the weapon 110 relative to the aim point of the aiming gimbal 5 and thus correct for the motion of the base 15. The tilt stabilizer 27 can include a precision elevation motor 26 and a linear gear assembly (not shown). The pan stabilizer 29 can include a precision azimuth motor 28 and a linear gear assembly (not shown). As best shown in FIGS. 1D and 1E, a region of the aiming gimbal 5 is mechanically coupled to one region of the elevation motor 26 and the azimuth motor 28 and a region of the stabilization gimbal 10 is mechanically coupled to another region of the motors 26, 28. During stabilization, the motors 26, 28 move the stabilization gimbal 10 relative to the aiming gimbal 5 such that the aiming gimbal 5 remains relatively stationary. Although the aiming gimbal 5 is mechanically coupled to the motors 26, 28, only the stabilization gimbal 10 can be moved by the motors 26, 28 unless the aiming gimbal 5 is configured for remote operation as discussed in more detail below. The motors and gear assemblies can be designed so that inspection, removal and replacement are easy and require no special tools. It should be appreciated that the way in which the components couple together can vary and their configuration is not limited by what is shown in the figures. For example, the motors 26, 28 can couple to the gimbals 5, 10 as shown in FIG. 1D or the motors 26, 28 can couple to the gimbals 5, 10 as shown in FIG. 1E. The figures show examples of the component configuration, but the component configuration shown is not limiting.

The stabilization gimbal 10 has at least two degrees of freedom relative to the aiming gimbal 5. Within the aiming gimbal 5, the stabilization gimbal 10 has a limited range of pan and tilt (depending on the mission requirements, the stabilization gimbal 6 can, for example, have +/− 5 deg to +/− 20 deg in azimuth and elevation). The range of motion can be determined by how much movement is expected from the vehicle (i.e. the vehicle platform 115 and, in turn, the base 15). For example, if the system 105 is mounted on vehicle platform 115 positioned on a boat and previous mission data stated the boat pitched and rolled +/− 10 degrees, the stabilization gimbal 10 can be configured to compensate for at least that much range of motion.

The electronics package 12 of the mount system 105 can interface with the motion sensors of the sensor suite 25 and positional sensors 20, 21 of the aiming gimbal 5, perform the stabilization calculations to interpret the base 15 motion and calculate the desired change in weapon attitude for appropriate correction, and transmit those changes to control the motors of the pan and tilt stabilizers 29, 27.

To calculate the appropriate motion to keep the weapon 110 aimed correctly, the mount system 105 includes an electronics package 12 having stabilization computational device, such as computational hardware and software, to keep track of the 6 degrees of freedom that the base 15 moves through (pitch, roll, yaw, x, y, z). Each of these degrees of freedom is individually monitored so that the stabilization computational device determines how the base 15 has moved with respect to earth. The stabilization computational device can also determine where the operator is pointing the aiming gimbal 5 with respect to the base 15.

Before the motion, the attitude of the aiming gimbal 5 and the range to the target define a vector from the base 15 to the target in the coordinate reference frame of the base 15. By translating and rotating the coordinate reference frame of the base 15 by the motion captured from the sensors of the sensor suite 25 (pitch, roll, yaw, x, y, and z), the target can be redefined with a new vector in the base platform reference frame. That frame can then be rotated and translated again into the reference frame of the aiming gimbal 5. The stabilization computational device of the electronics package 12 can then find the difference in azimuth and elevation from the previous vector and the new vector (in the aiming gimbal reference frame). This difference is how much the inner stabilization gimbal 10 needs to move relative to the aiming gimbal 5 to correct for the motion of the base 15.

Depending on the base 15, sensor availability, and expected motion profile, one or more of the inputs can be discarded without corrupting system functionality. For example, when mounted onto a small boat, a yaw sensor could be ignored if the sensors available were unable to determine what part of the yaw motion was due to wave action and what part was due to the boat changing course.

When the stabilization computational device sends the commands to the motors of the pan and tilt stabilizers 29, 27 they move the stabilization gimbal 10 the requested amount relative to the aiming gimbal 5. The outer aiming gimbal 5 can remain free to move with respect to the base 15. This continual recalculation of the reference frames allows the operator to freely move and aim the system 105 while the system 105 is stabilized. When the base 15 is moving, the aim point of the weapon 110 can stay the same if the operator does not move the aiming gimbal 5. If the operator moves the aiming gimbal 5, the aim point of the weapon 110 can be shifted by that amount, and not by the motion of the base 15.

As mentioned above, the aiming gimbal 5 can be moved freely and can be aimed directly by the operator. The aiming gimbal 5 can be coupled at one end to an operator interface or control grip 30 that allows for the safe operation and monitoring of the stabilized mount system 105. The control grip 30 can be designed to match as closely as possible the controls of the weapon 110 being used with the mount system 105. For example, the control grip 30 can match the existing M2 interface. The mount system 105 can also include a trigger actuator 32 (see FIG. 1D) mechanically linking a trigger on the weapon 110 to a trigger 33 on the control grip 30. The mechanical linkage mechanism of the trigger actuator 32 can vary. For example, the trigger actuator 32 can incorporate a pull cable or lever system such as used in the actuators of a bicycle brake. If the mount system 105 is upgraded for remote operation, the trigger actuator 32 can be replaced with an electronic motor/solenoid. In addition to allowing the operator to operate the weapon 110 (e.g. fire the weapon, determine target range, etc), the control grip 30 can also include "dead man" switches 34 that disable the stabilization gimbal 10 when released. The control grip 30 can also include a manual range input device (not shown). The mount system 105 can also include ammunition storage 35.

The mount system 105 can correct for the motion of the base 15. The motion sensors 25 of the mount system 105 can also be adapted to minimize or prevent operator-induced error. The main tilt assist 40 and main pan assist 45 can each include a damper, brake and/or a motor. These pan and tilt assists 40, 45 can be activated, for example, when large and/or sudden base motions are detected by the motion sensors 25. When the pan and/or tilt assist is activated, the motion of the aiming gimbal 5 in that axis can be temporarily limited so that operator-induced error is prevented, minimized or eliminated. For example, a sudden decrease in platform velocity might throw the operator forward. The motion sensors can detect the deceleration instantaneously and "lock up" the pan and tilt axis of the aiming gimbal 5. The stabilization gimbal 10 can still stay on target, but the operator would not be able to move the aiming gimbal 5 until after the sudden change in motion was over. The threshold for activation of the assists 40, 45 and the level of motion limitation (from small increase in friction to complete lack of motion) can vary and can be configurable.

As mentioned above, the mount system 105 can be adapted to be controlled remotely. The electronics package 12 can be compatible with numerous digital interfaces including Ethernet, JAUS, TCP, UDP, RCP, RS-232, RS-422, RS-485 and other data interfaces. The interfaces can allow, for example, for upgrades including full remote operation and remote diagnostics. A remote control upgraded mount system 105 can include a main tilt assist 40, a main pan assist 45, a video display (not shown), a remote interface (not shown) and a weapon charging kit (not shown). The main tilt assist 40 and main pan assist 45 can each include a damper and/or a motor and rotary position sensor. The weapon charging kit can also be included that allows the operator to remotely manipulate the charging handle of the weapon. A remotely controlled system can include one or more motors coupled to the aiming gimbal 5.

The mount system 105 can optionally include an optics package 50 (see FIG. 1A) to allow the operator to view a stabilized image of the target either locally or remotely. The components of the optics package 50 can vary and can include, for example, a portable video display with an onboard camera, video scope, radar, automatic ranging device, day camera or a thermal night camera.

The mount system 105 also can be equipped with target sensors (not shown) such as cameras and/or laser range finders to further increase the stabilization and target acquisition effectiveness. When the system 105 is equipped with these sensors, the system 105 not only corrects for the motion of the platform 15, but it also adjusts the aim point to correct for target range and speed. With knowledge of the target range, the muzzle speed and ballistics of the round, the stabilization computational device can calculate the difference in weapon aim point and impact point. That difference can either be added to the stabilization motion change sent to the motors of the pan and tilt stabilizers 29, 27, or can be displayed to the operator via a change in the weapon retical location or a secondary weapon retical.

Using the time required for the round to travel to the target, and the speed the target is traveling, the stabilization computational device can calculate the difference in weapon aim point to correct for the movement of the target. That difference can either be added to the stabilization motion change sent to the motors of the pan and tilt stabilizers 29, 27, or can be displayed to the operator via a change in the weapon retical location or a secondary weapon retical. The data does not need to come from direct measurement, for example, by using the range to the target and the angular velocity of the aiming gimbal. The system 105 can assume the operator is tracking the target and by using simple geometry can calculate the targets tangential speed. One example target sensor can be a user input device to allow the operator to manually set target range.

Figure 2:
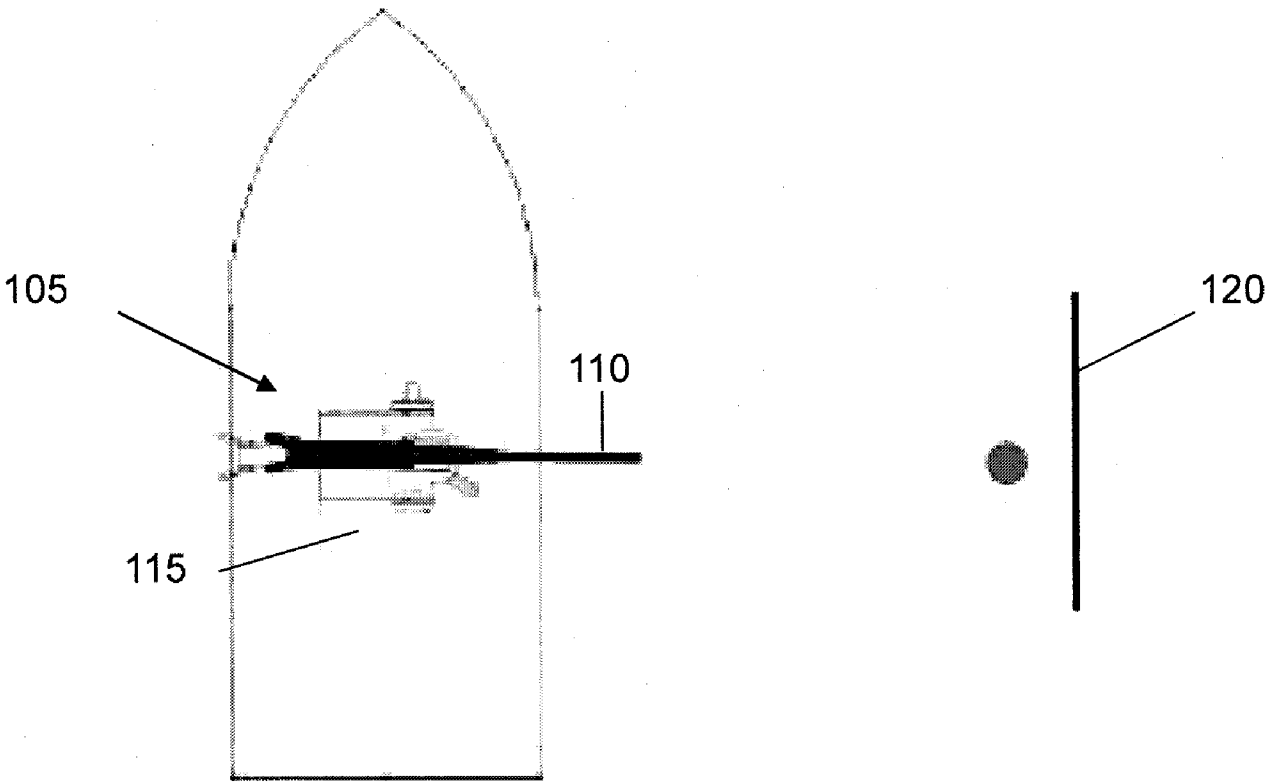
FIG. 2 illustrates a top view of a stabilized weapon mount on a boat aiming 90 degrees starboard at a target.

The following are examples of motion corrections performed by stabilized weapon mount system 105. FIG. 2 shows a top view of a weapon coupled to a stabilized weapon mount system 105 and coupled to a vehicle platform 115 on a boat. The system 105 and weapon 110 are aiming 90 degrees starboard at a target 120. This setup can be used for the following three scenarios (1) platform rotational motion; (2) platform linear motion; and (3) platform rotational and linear motion.

Figure 3A:
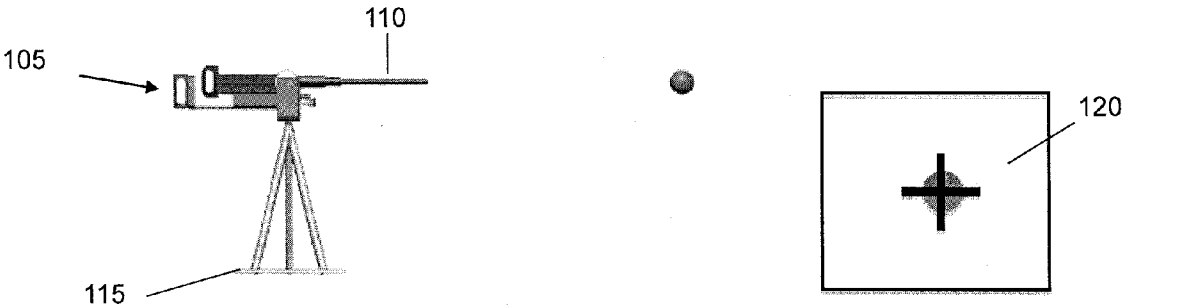
FIG. 3A illustrates a stabilized weapon mount in a rotational motion scenario before motion.
Figure 3B:
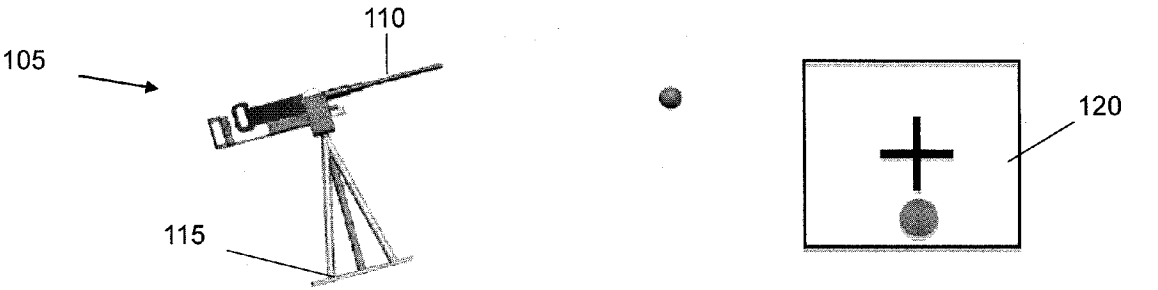
FIG. 3B illustrates the stabilized weapon mount of FIG. 3A in a rotational motion scenario after motion and before correction.
Figure 3C:
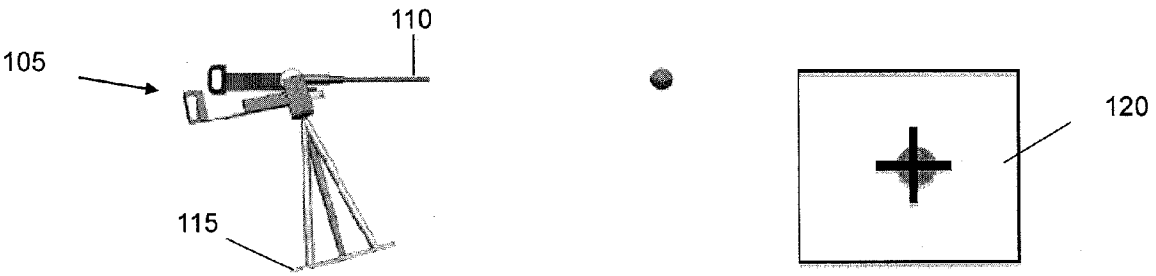
FIG. 3C illustrates the stabilized weapon mount of FIG. 3A in a rotational motion scenario after correction.

In the platform rotational motion scenario (see FIGS. 3A-3C), the only motion is in the rotation of the vessel bringing up the starboard side and bringing down the port side. The position sensors 20, 21 of the aiming gimbal 5 report to the stabilization computational device that the elevation is zero and the azimuth is 90 to the starboard. When the gyroscope of the motion sensor suite 25 detects the "roll" motions, the stabilization computational device transforms the "roll" motion into the coordinate frame of the aiming gimbal 5, calculates that the azimuth should not change and that the elevation should be depressed relative to the aiming gimbal 5. FIG. 3A illustrates the stabilized mount system 105 in a rotational motion scenario before motion, FIG. 3B illustrates the stabilized mount system 105 in a rotational motion scenario after motion and before correction, and FIG. 3C illustrates the stabilized mount system 105 in a rotational motion scenario after correction.

Figure 4A:
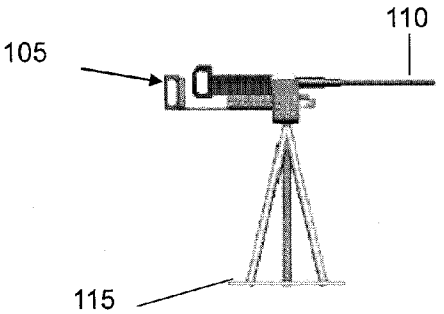
FIG. 4A illustrates a stabilized weapon mount in a linear motion scenario before motion.
Figure 4A:
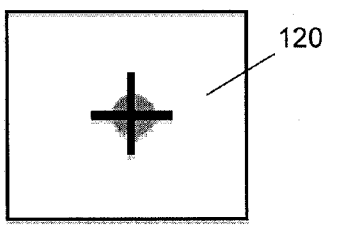
Figure 4B:
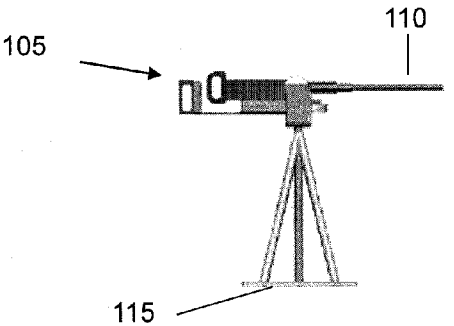
FIG. 4B illustrates the stabilized weapon mount of FIG. 4A in a linear motion scenario after motion and before correction.
Figure 4B:
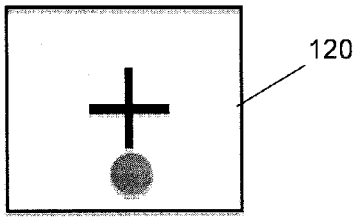
Figure 4C:
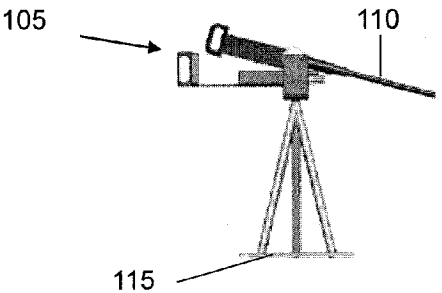
FIG. 4C illustrates the stabilized weapon mount of FIG. 4A in a linear motion scenario after correction.
Figure 4C:
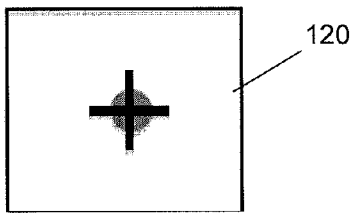

In the platform linear motion scenario (see FIGS. 4A-4C), the only motion is in the rising of the vessel straight up with no rotation about any axis. The position sensors 20, 21 of the aiming gimbal 5 report to the stabilization computational device that the elevation is zero and the azimuth is 90 to the starboard. When the acceleration sensor of the motion sensor suite 25 detects the vertical change, the stabilization computational device can calculate the distance traveled. Using that data along with the range of the target, the stabilization computational device can calculate the change in bearing relative to the aiming gimbal 5 needed to keep the weapon 110 aimed at the target 120. The azimuth does not change and the elevation is depressed relative to the aiming gimbal 5. FIG. 4A illustrates a stabilized mount system 105 in a linear motion scenario before motion, FIG. 4B illustrates the stabilized mount system 105 in a linear motion scenario after motion and before correction, and FIG. 4C illustrates the stabilized mount system 105 in a linear motion scenario after correction.

Figure 5A:
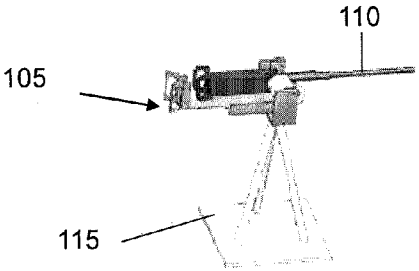
FIG. 5A illustrates a stabilized weapon mount in a rotational and linear motion scenario before motion.
Figure 5A:
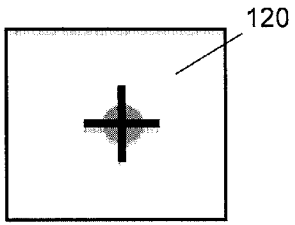
Figure 5B:
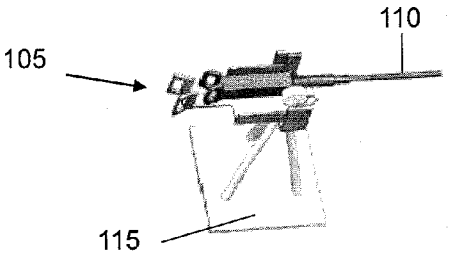
FIG. 5B illustrates the stabilized weapon mount of FIG. 5A in a rotational and linear motion scenario after motion and before correction.
Figure 5B:
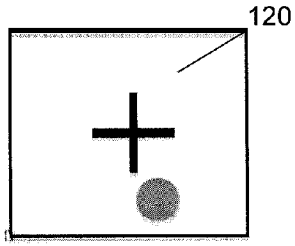
Figure 5C:
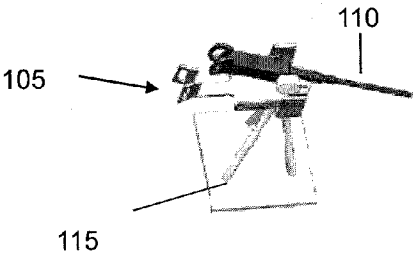
FIG. 5C illustrates the stabilized weapon mount of FIG. 5A in a rotational and linear motion scenario after correction.
Figure 5C:
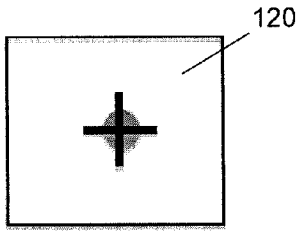

In the platform rotational and linear motion example (see FIGS. 5A-5C), the platform 115 can be raised straight up, and then platform 115 can be rotated so that the bow comes up and the stern drops down. The stabilization computational device translates and transforms the motion of the platform 115 into the reference plane of the aiming gimbal 5. When the system 105 moves straight up and then "pitches" back, the resultant change for the stabilizing gimbal 10 is down and to the right.

None of these three described motion scenarios change the aim point of the aiming gimbal 5 relative to the platform 115.

The stabilization achieved is relative to where the operator has pointed the aiming gimbal 5. In other words, the stabilizing gimbal 10 is moved and stabilized by the motors relative to the aiming gimbal 5 rather than the aiming gimbal being moved and stabilized by the motors relative to the platform 115.

When the system 105 is turned on, it can begin reading data from all sensors 20, 21, 25 and start determining platform attitude (orientation with respect to the horizon, speed, and acceleration). System initialization can occur without operator input. By comparing the acceleration vectors in the x, y, and z axis with the rate data from the position sensors 20, 21, the system 105 can determine its orientation without knowledge of its initial orientation.

When the operator grips the operator interface or control grip 30 and engages a dead man safety, the system 105 is activated, but does not begin to stabilize. Once the operator "pulls the trigger" to initiate target engagement, the system 105 can begin to stabilize and maintain the weapon 110 aiming at the same location. If the vessel or vehicle rotates about an axis, or moves linearly (e.g. raises up with a wave), the stabilization computational device of the electronics package 12 can calculate the change and then move the stabilization gimbal 10 to correct for the motion. The operator can be able to correct the aim point or "walk in the rounds" by moving the aiming gimbal 5. If the operator moves the aiming gimbal 5 3 degrees to the port, the electronics package 12 and stabilization gimbal 10 can maintain the weapon 110 aimed at a point 3 degrees to the port of the original aim point. The operator can manually set the range of the target using a range selector, or have the range set automatically with a range finder. The operator can use the "iron sites" on the weapon 110 or an optics package 50 if included such as a portable video display with an onboard camera, video scope, radar, automatic ranging device, day camera or a thermal night camera and the like. If the operator uses the an optics package 50 the electronics package 12 can "paint" an electronic retical on the video screen that shows the corrected aim point (correcting for range, platform motion, and target motion).

When the operator "releases the trigger" to disengage, the system 105 can continue to stabilize on the target for a configurable amount of time, for example by incorporating a timer. During that time, the operator can "pull the trigger" to keep the system 105 stabilizing on the target, cancel the timer, or allow the timer to run out. Once the timer has expired or been canceled, the stabilizing gimbal 10 resets to its zero location and returns to being in line with the aiming gimbal 5.

If at any point the operator releases the "dead man" safety, the stabilization gimbal 10 can be immediately disabled. The weapon 110 can still fire normally, but the motion motors 20, 21 are disabled.

Aspects of the subject matter described herein may be realized in digital electronic circuitry, integrated circuitry, specially designed ASICs (application specific integrated circuits), computer hardware, firmware, software, and/or combinations thereof. These various implementations may include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and may be implemented in a high-level procedural and/or object-oriented programming language, and/or in assembly/machine language. As used herein, the term "machine-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

While this specification contains many specifics, these should not be construed as limitations on the scope of what is claimed or of what may be claimed, but rather as descriptions of features specific to particular variations. Certain features that are described in this specification in the context of separate variations can also be implemented in combination in a single variation. Conversely, various features that are described in the context of a single variation can also be implemented in multiple variations separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results. Only a few examples and implementations are disclosed. Variations, modifications and enhancements to the described examples and implementations and other implementations may be made based on what is disclosed.

What is claimed is:

1. A stabilized weapon mount system, comprising:

a base including at least one motion sensor adapted to sense base movement;

an aiming gimbal moveably mounted to the base comprising an operator interface, a first position sensor, and a second position sensor, wherein the aiming gimbal is movable by an operator during stabilization into an aiming orientation directed toward a target;

a control unit comprising a first motor and a second motor;

a stabilization gimbal nested within the aiming gimbal and adapted to securely couple to a weapon, wherein the stabilization gimbal and aiming gimbal are mechanically coupled by the control unit such that the stabilization gimbal is moved by the control unit and the aiming gimbal is not moved by the control unit; and a stabilization computational device electrically interfaced with the at least one motion sensor of the base, the first and second position sensors of the aiming gimbal, and the control unit, wherein the stabilization computational device automatically commands the control unit to move the stabilization gimbal relative to the aiming gimbal using one or more of the first motor and the second motor to correct for the base movement sensed by the at least one motion sensor and maintain the aiming orientation directed toward the target.

2. The system of claim 1, wherein the base is affixed to a platform of a movable vehicle.

3. The system of claim 1, wherein the base movement comprises rotational motion, linear motion or a combination of rotational and linear motion.

4. The system of claim 1, wherein the first motor comprises an elevation motor and the second motor comprises an azimuth motor.

5. The system of claim 1, wherein the first position sensor comprises an elevation sensor and the second position sensor comprises an azimuth sensor.

6. The system of claim 1, wherein the aiming gimbal has two degrees of freedom relative to the base comprising azimuth and elevation.

7. The system of claim 1, wherein the stabilization gimbal has two degrees of freedom relative to the aiming gimbal comprising azimuth and elevation.

8. The system of claim 1, wherein the aiming gimbal is coupled to at least a third motor for remote operation.

9. The system of claim 1, wherein the aiming gimbal is manually moved by the operator.

10. The system of claim 1, wherein the at least one motion sensor comprises a plurality of axis motion sensors comprising a gyroscope, an accelerometer or a combination thereof.

11. The system of claim 10, wherein the plurality of axis motion sensors detect motion in at least one of six degrees of freedom comprising pitch, roll, yaw, x, y, or Z.

12. The system of claim 1, wherein the operator interface is adapted to operate the weapon like a stand-alone weapon.

13. The system of claim 1, further comprising a target sensor adapted to adjust for motion, range and speed of the target.

14. The system of claim 13, wherein the target sensor comprises a manual user input device.

15. The system of claim 1, further comprising a safety switch coupled to the operator interface that disables the control unit when released by the operator.

16. The system of claim 1, wherein the at least one motion sensor is adapted to detect sudden base movement and activate at least one of a pan assist and a tilt assist coupled to the aiming gimbal to limit motion of the aiming gimbal relative to the base and prevent operator-induced error.

17. The system of claim 1, wherein the system is adapted to be controlled remotely.

18. The system of claim 1, wherein the aiming gimbal remains substantially stationary when the control unit moves the stabilization gimbal.

19. A stabilizing weapon mount system, comprising: a base including at least one motion sensor adapted to sense base movement in at least one of six degrees of freedom;

an aiming gimbal moveably mounted to the base in two degrees of freedom, the aiming gimbal having an aiming orientation directed toward a target;

a first sensor positioned on the aiming gimbal, the first sensor adapted to detect elevation data of the aiming gimbal;

a second sensor positioned on the aiming gimbal, the second sensor adapted to detect azimuth data of the aiming gimbal;

a control unit comprising an elevation motor and an azimuth motor;

a stabilization gimbal nested within the aiming gimbal in two degrees of freedom and adapted to securely couple to a weapon, wherein the stabilization gimbal and the aiming gimbal are mechanically coupled by the control unit such that the stabilization gimbal is moved by the control unit and the aiming gimbal is not moved by the control unit; and a stabilization computational device electrically interfaced with the at least one motion sensor of the base, the first and second sensors of the aiming gimbal, and the control unit, wherein the stabilization computational device automatically corrects for the base movement sensed by the at least one motion sensor by commanding the control unit to move the stabilization gimbal using one or more of the first motor and the second motor to maintain the aiming orientation directed toward the target while the aiming gimbal remains substantially stationary.

20. A method of stabilizing a weapon coupled to a moving vehicle, comprising:

detecting aiming orientation of an aiming gimbal directed toward a target, the aiming gimbal moveably mounted in two degrees of freedom to a base having at least one motion sensor, the base coupled to the moving vehicle;

detecting elevation of the aiming gimbal with a first sensor on the aiming gimbal;

detecting azimuth of the aiming gimbal with a second sensor on the aiming gimbal;

reporting elevation and azimuth data of the aiming gimbal to a stabilization computational device to calculate a first vector of the aiming gimbal;

detecting base motion with the at least one motion sensor in one of six degrees of freedom;

reporting base motion data to the stabilization computational device to calculate a second vector;

calculating the difference in azimuth and elevation between the first vector and the second vector to generate a correction command;

transmitting the correction command to a control unit comprising a first motor and a second motor, wherein the stabilization gimbal and the aiming gimbal are mechanically coupled by the control unit such that stabilization gimbal is nested within the aiming gimbal and moved by the control unit; and automatically correcting for the difference in one or more of azimuth and elevation with the control unit by moving the stabilization gimbal relative to the aiming gimbal using one or more of the first motor and the second motor to maintain the aiming orientation while the aiming gimbal remains substantially stationary.

* * * * *